US007845766B2

(12) United States Patent
Kimura et al.

(10) Patent No.: US 7,845,766 B2
(45) Date of Patent: Dec. 7, 2010

(54) INKJET RECORDING HEAD

(75) Inventors: Satoshi Kimura, Kawasaki (JP); Genji Inada, Koshigaya (JP); Torachika Osada, Yamato (JP); Keisuke Matsuo, Yokohama (JP); Satoshi Kudo, Machida (JP); Yukuo Yamaguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 375 days.

(21) Appl. No.: 12/145,427

(22) Filed: Jun. 24, 2008

(65) Prior Publication Data

US 2009/0002445 A1 Jan. 1, 2009

(30) Foreign Application Priority Data

Jun. 27, 2007 (JP) ..... 2007-169351

(51) Int. Cl.
*B41J 2/05* (2006.01)

(52) U.S. Cl. ..... 347/65; 347/40; 347/58; 347/50

(58) Field of Classification Search ..... 347/12, 347/20, 40, 44, 47, 50, 56–58, 61–65, 67, 347/92–94
See application file for complete search history.

(56) References Cited

U.S. PATENT DOCUMENTS 5,030,971 A * 7/1991 Drake et al. ..... 347/57
6,830,317 B2 * 12/2004 Tsuchii et al. ..... 347/56
6,863,381 B2 3/2005 Parish et al.

* cited by examiner

*Primary Examiner*—Juanita D Stephens
(74) *Attorney, Agent, or Firm*—Canon USA Inc IP Div

(57) ABSTRACT

An inkjet recording head includes a recording-element substrate having arranged therein multiple sets of nozzles that discharge ink, energy-generating elements that generate energy used for discharging the ink, and supply ports that supply the ink to the nozzles; and a sealant disposed around the recording-element substrate. The supply ports include a first supply port disposed near a first edge of the recording-element substrate and a second supply port disposed near a second edge of the recording-element substrate, the second edge being opposite to the first edge as viewed in the arrangement direction of the multiple sets. As viewed in the arrangement direction, a distance between the second edge and the second supply port is shorter than a distance between the first edge and the first supply port, and a volume of the sealant near the second edge is smaller than a volume of the sealant near the first edge.

7 Claims, 4 Drawing Sheets

INKJET RECORDING HEAD

BACKGROUND OF THE INVENTION

1. Field of the Invention

The present invention relates to inkjet recording heads that discharge ink towards a recording face of a recording medium to perform a recording operation. In particular, the present invention relates to an inkjet recording head in which a flexible film substrate is mounted on a substrate that holds recording elements for generating energy used for discharging ink.

2. Description of the Related Art

Inkjet recording apparatuses are recording apparatuses of a non-impact recording type and are greatly advantageous in terms of releasing almost no noise during recording and having the capability to record high resolution images on various kinds of recording media at high speed. U.S. Pat. No. 6,863,381 discloses an example of an inkjet recording apparatus. In the inkjet recording apparatus disclosed in U.S. Pat. No. 6,863,381, ink-discharging nozzle arrays are disposed adjacent to only one side of supply ports provided in a recording-element substrate (heater chip). In addition, regarding these supply ports in the recording-element substrate, the distance from a long edge of a first outermost supply port to a first edge of the recording-element substrate is different from the distance from a long edge of a second outermost supply port to a second edge of the recording-element substrate.

An inkjet recording head typically used in an inkjet recording apparatus generally has nozzle plates each equipped with small ink discharge nozzles (which will simply be referred to as nozzles hereinafter). An inkjet recording head also has a recording-element substrate equipped with a plurality of discharge-energy generating elements that apply discharge energy to a liquid flow passage and to recording liquid within the liquid flow passage. A surrounding area around the recording-element substrate and a part of an electrical connection between the recording-element substrate and a flexible film wiring substrate are coated with a sealant. This sealant protects these elements from corrosion caused by the recording liquid, from short circuit, and from an external force applied during, for example, wiping.

With the advancement in recording technologies in recent years, the inkjet technology needs to have the capability to record higher resolution images. To achieve this, inkjet recording heads require extremely small nozzles.

However, the aforementioned recording head has the following problems. Specifically, after the sealant is applied on the recording-element substrate, the sealant shrinks as it becomes cured. The stress produced by this shrinkage of the sealant can cause deformation of the nozzle plates and the nozzles. The deformation is especially conspicuous at the outermost nozzle arrays on the recording-element substrate, and can be even more influential if the nozzles are extremely small in size. The deformation leads to inconsistency in the discharging direction of ink droplets, resulting in unevenness of the ink density on the output image. Especially in the case of U.S. Pat. No. 6,863,381 where the recording-element substrate has the discharge-energy generating elements disposed adjacent to only one side of the supply ports and has the supply ports arranged such that the long edges of the outermost supply ports and the opposite edges of the recording-element substrate are spaced apart by asymmetrical distances, the following problems tend to occur. The effect of shrinkage stress of the sealant at the side with the relatively shorter distance is greater than that at the side with the relatively longer distance. As a result, the degree of deformation of the nozzle plates and the nozzles may be unbalanced between the two sides. Minimizing the deformation of the nozzles can be achieved by reducing the effect the shrinkage effect of the sealant has on the nozzles. This can be done by reducing the width of the sealant. However, if the sealant is to be reduced in width, it may make it difficult for the sealant to flow when it is being applied onto the recording-element substrate, which can possibly lead to an increase in manufacturing tact time in the sealant application process performed at the time of production of inkjet heads, the sealant application process including, for example, emission control and positional adjustment of the sealant. In addition, simply reducing the width of the sealant can cause deformation of the nozzles due to a difference in shrinkage stress of the sealant between the opposite edges of the recording-element substrate.

SUMMARY OF THE INVENTION

The present invention provides an inkjet recording head in which deformation of nozzle plates caused by shrinkage stress of a cured sealant that surrounds a recording-element substrate is minimized so as to allow for a stable discharging process.

According to an aspect of the present invention, an inkjet recording head includes a recording-element substrate in which multiple sets of nozzles, energy-generating elements, and supply ports are arranged, the nozzles being configured to discharge ink, the energy-generating elements being configured to generate energy used for discharging the ink, the supply ports being configured to supply the ink to the nozzles; and a sealant disposed around the recording-element substrate. The supply ports include a first supply port disposed proximate to a first edge of the recording-element substrate and a second supply port disposed proximate to a second edge of the recording-element substrate, the second edge being opposite to the first edge as viewed in an arrangement direction in which the multiple sets are arranged. As viewed in the arrangement direction, a distance between the second edge and the second supply port is shorter than a distance between the first edge and the first supply port, and a volume of the sealant near the second edge is smaller than a volume of the sealant near the first edge.

Accordingly, even in an inkjet recording head in which the nozzles are arranged at high density and the recording-element substrate is small in size, deformation of the nozzles can be minimized, thereby allowing for a stable discharging process.

Further features of the present invention will become apparent from the following description of exemplary embodiments with reference to the attached drawings.

DESCRIPTION OF THE EMBODIMENTS

Exemplary embodiments of the present invention will now be described with reference to the drawings.

First Exemplary Embodiment

Figure 1:
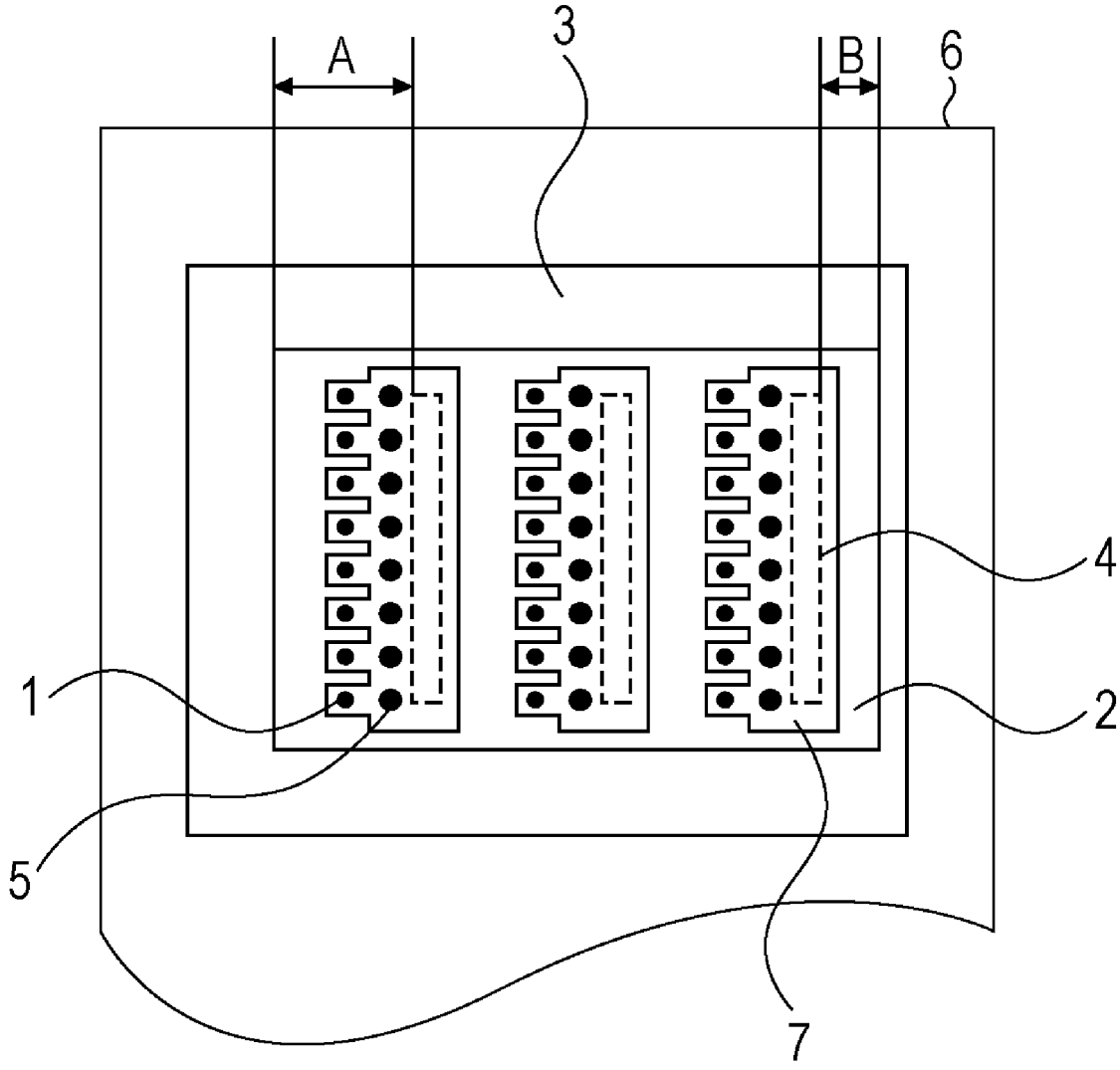
FIG. 1 schematically illustrates a recording head according to a first embodiment of the present invention.

FIG. 1 schematically illustrates an inkjet recording head 6 according to a first embodiment of the present invention, as viewed from the side with nozzles. In FIG. 1, the inkjet recording head 6 has nozzle plates 7 each equipped with a plurality of nozzles 1 that discharge recording liquid. In addition, the inkjet recording head 6 has a recording-element substrate 2 in which multiple sets of energy-generating elements (not shown) and supply ports 4 are arranged. Each set is constituted by an energy-generating element and a supply port 4 and is positioned facing the corresponding set of nozzles 1. The energy-generating elements generate energy used for discharging the recording liquid (ink). On the other hand, the supply ports 4 communicate with the nozzles 1. The surrounding area around the recording-element substrate 2 is coated with a sealant 3 for protection against corrosion caused by the recording liquid and also against short circuit. Each supply port 4 has a plurality of filters 5 arranged adjacent thereto. The filters 5 are columnar filters that are disposed on the recording-element substrate 2 and are in contact with the corresponding nozzle plates 7.

Regarding the multiple supply ports 4 provided in the recording-element substrate 2 shown in FIG. 1, a distance A from a long edge of a first outermost supply port 4 to a first edge of the recording-element substrate 2 is different from a distance B from a long edge of a second outermost supply port 4 to a second edge of the recording-element substrate 2. The side of the recording-element substrate 2 that is proximate to an outermost supply port 4 with a shorter distance from a long edge thereof to an edge of the recording-element substrate 2, namely, the side of the recording-element substrate 2 that is proximate to the second outermost supply port 4 with the distance B when A>B as in FIG. 1, is more susceptible to shrinkage stress of the sealant 3. This implies that the nozzles 1 on this side of the recording-element substrate 2 may tend to become deformed more easily. Deformation of these nozzles 1 can adversely affect the discharge characteristics of the recording liquid, which can result in a reduced printing quality.

The first embodiment solves this problem by applying the sealant 3 around the recording-element substrate 2 shown in FIG. 1 in view of the following point. Specifically, the width of a sealant region located proximate to the outermost supply port 4 with a shorter distance from a long edge thereof to an edge of the recording-element substrate 2, that is, the second outermost supply port 4 with the distance B when A>B, is made smaller than the width of a sealant region located proximate to the first outermost supply port 4 with the distance A. As mentioned above, in the first embodiment, when viewed in a direction crosswise to the array direction of the nozzles 1, the distance from the first edge of the recording-element substrate 2 to the first supply port 4 is referred to as a distance A and the distance from the second edge of the recording-element substrate 2, which is opposite to the first edge, to the second supply port 4 is referred to as a distance B. When A>B, the volume of sealant applied to the region adjacent to the second edge is smaller than the volume of sealant applied to the region adjacent to the first edge. The terms "A-side" and "B-side" will be used hereinafter to refer to the side corresponding to the distance A and the side corresponding to the distance B, respectively.

With this configuration, the effect that the shrinkage stress of the sealant at the B-side has on the recording-element substrate 2 can be alleviated, thereby minimizing the deformation of the nozzles 1. In other words, in a recording-element substrate in which the outermost supply ports and the opposite edges of the substrate are spaced apart by different distances as in this embodiment, the effect of shrinkage stress can be balanced out between the opposite edges of the recording-element substrate by giving different widths to the sealant regions. As a result, this can minimize the deformation of the nozzles 1. Regarding the sealant region to be given the smaller width, a sealant is applied over the region by utilizing a capillary force at the time of the sealant application process. Therefore, deformation of the nozzles 1 can be suppressed without having to increase the manufacturing tact time.

Second Exemplary Embodiment

Figure 2A:
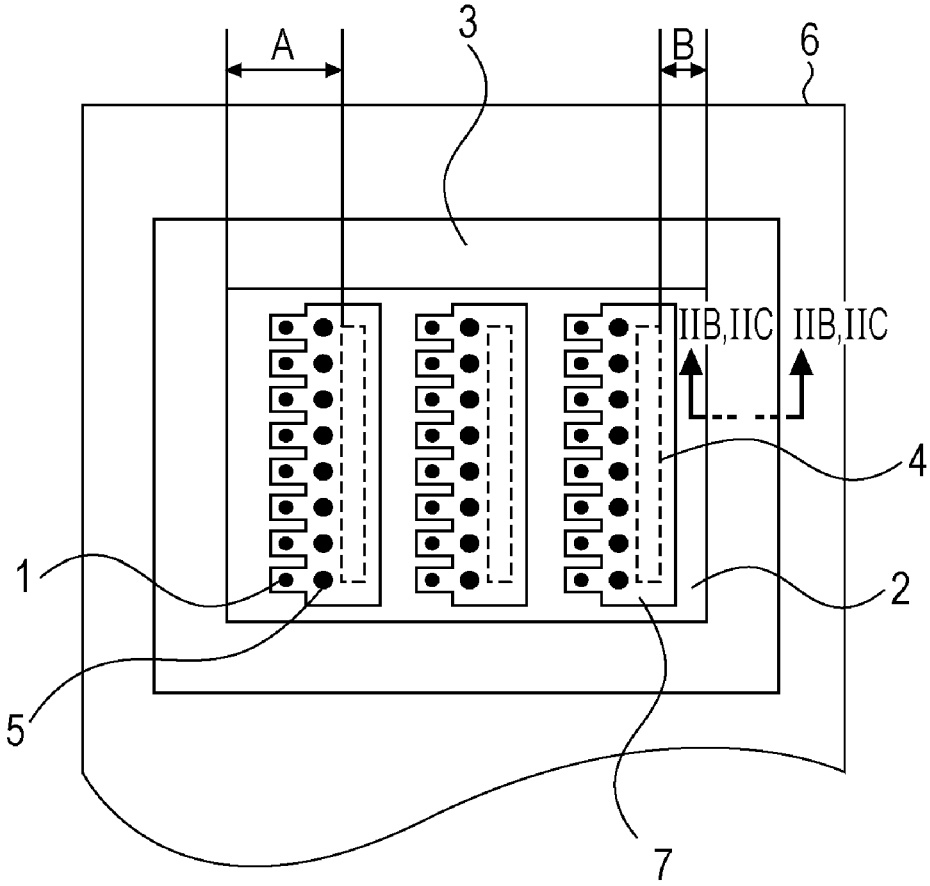
FIGS. 2A to 2C schematically illustrate a recording head according to a second embodiment of the present invention.
Figure 2B:
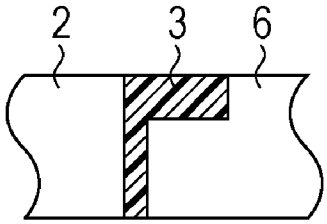
Figure 2C:
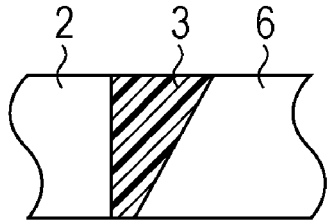

FIGS. 2A to 2C schematically illustrate an inkjet recording head 6 according to a second embodiment of the present invention. Specifically, FIG. 2A shows the inkjet recording head 6 as viewed from the side with the nozzles 1, and FIGS. 2B and 2C are cross-sectional views taken along lines IIB-IIB and IIC-IIC, respectively, in FIG. 2A. As shown in FIGS. 2B and 2C, in this embodiment, when A>B, the width of the sealant region at the B-side varies, or more specifically, decreases in the height direction (depth direction) from the top surface thereof. In other words, by allowing the volume of the sealant to vary in this manner, the effect the shrinkage stress of the sealant at the B-side has on the recording-element substrate 2 can be alleviated. Thus, the effect of shrinkage stress can be balanced out between the opposite edges of the recording-element substrate 2. As a result, this can minimize the deformation of the nozzles 1.

Third Exemplary Embodiment

Figure 3:
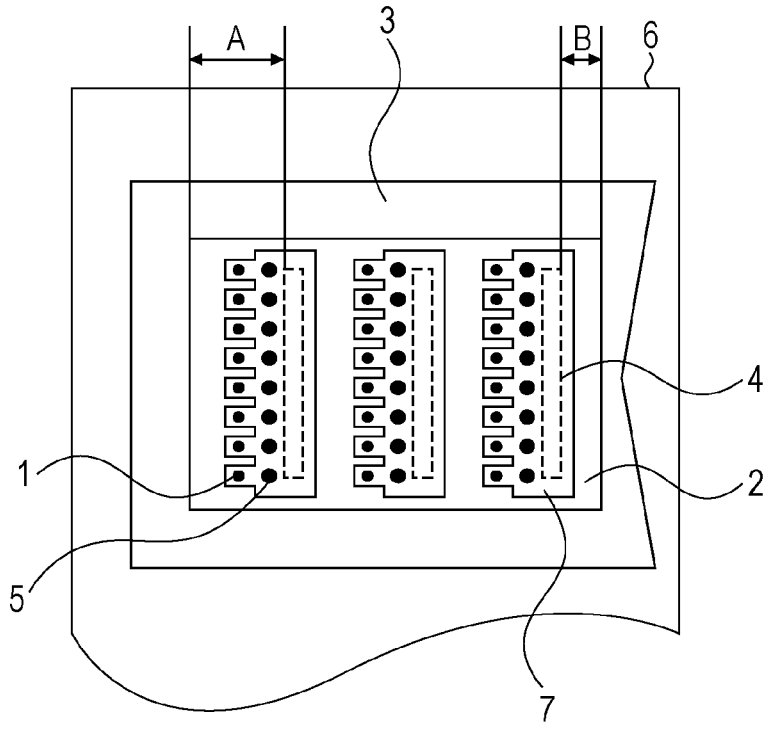
FIG. 3 schematically illustrates a recording head according to a third embodiment of the present invention.

FIG. 3 schematically illustrates an inkjet recording head 6 according to a third embodiment of the present invention, as viewed from the side with the nozzles 1. Similar to the above, when A>B, the width of the sealant region at the B-side is made smaller in this embodiment. In particular, the sealant region at the B-side is designed such that the width of the sealant region gradually decreases from the opposite longitudinal ends thereof towards the center of the nozzle array at the B-side. By giving the sealant region a smaller width especially near the center of the nozzle array which is where the nozzles are apt to become deformed, the effect the shrinkage stress of the sealant at the B-side has on the recording-element substrate 2 can be alleviated, thereby minimizing the deformation of the nozzles 1.

Fourth Exemplary Embodiment

Figure 4:
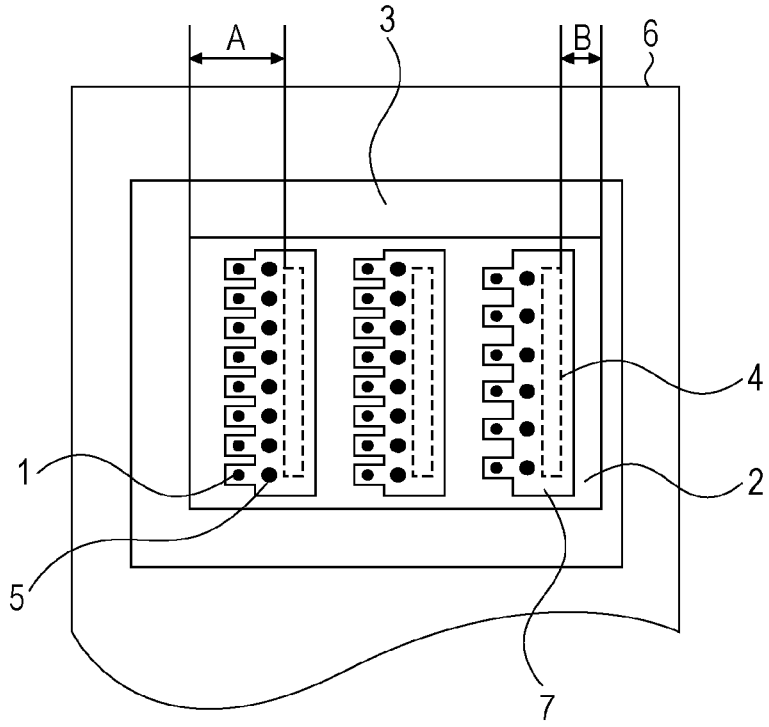
FIG. 4 schematically illustrates a recording head according to a fourth embodiment of the present invention.

FIG. 4 schematically illustrates an inkjet recording head 6 according to a fourth embodiment of the present invention, as viewed from the side with the nozzles 1. In addition to giving the sealant region at the B-side a smaller volume as in the above embodiments, this embodiment is characterized in that the density of the nozzles 1 arranged at the A-side is different from that of the nozzles 1 arranged at the B-side. Specifically, the recording-element substrate 2 does not allow a nozzle array of the highest density to be disposed at the B-side. It is preferable that the recording-element substrate 2 have a nozzle array of the lowest density disposed at the B-side. This can allow the joint area between the recording-element substrate 2 and the flow-passage forming member (i.e. the nozzle plate 7) at the B-side to be greater than that at the A-side, thereby further minimizing the deformation of the nozzles 1.

Fifth Exemplary Embodiment

Figure 5:
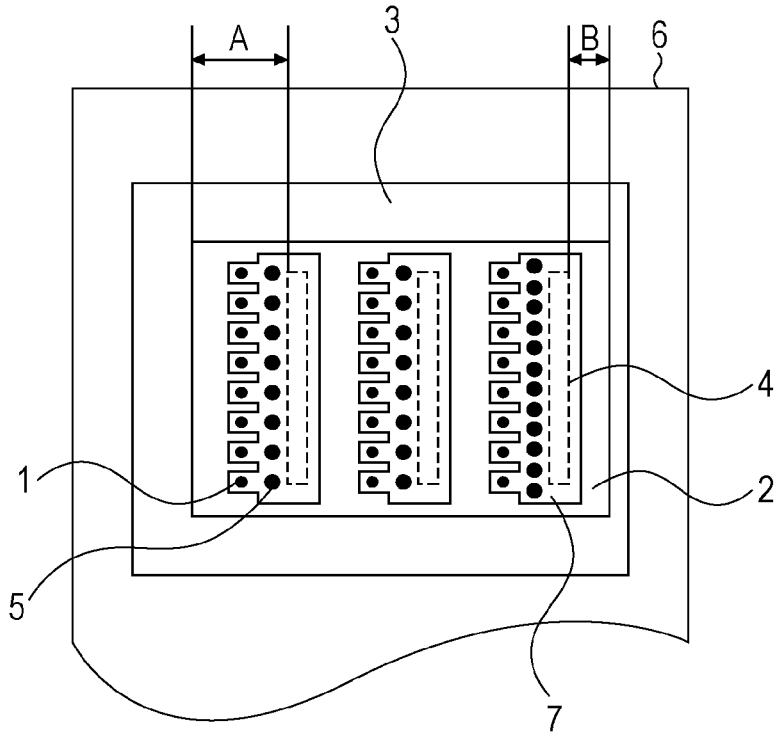
FIG. 5 schematically illustrates a recording head according to a fifth embodiment of the present invention.

FIG. 5 schematically illustrates an inkjet recording head 6 according to a fifth embodiment of the present invention. In addition to giving the sealant region at the B-side a smaller volume as in the above embodiments, this embodiment is characterized in that the filters 5 at the B-side are arranged at a higher density than the filters 5 at the A-side. This can allow the joint area between the recording-element substrate 2 and the flow-passage forming member (i.e. the nozzle plate 7) at the B-side to be greater than that at the A-side, thereby further minimizing the deformation of the nozzles 1.

Sixth Exemplary Embodiment

Figure 6:
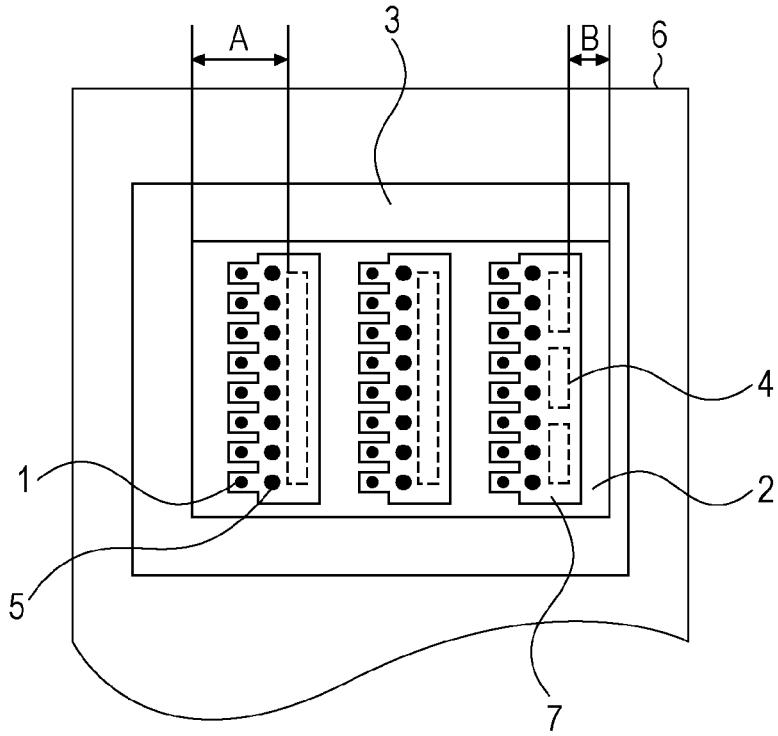
FIG. 6 schematically illustrates a recording head according to a sixth embodiment of the present invention.

FIG. 6 schematically illustrates an inkjet recording head 6 according to a sixth embodiment of the present invention. In addition to giving the sealant region at the B-side a smaller volume as in the above embodiments, this embodiment is characterized in that the supply port 4 at the B-side is divided into segments in the longitudinal direction thereof. This can allow the joint area between the recording-element substrate 2 and the flow-passage forming member (i.e. the nozzle plate 7) at the B-side to be greater than that at the A-side, thereby further minimizing the deformation of the nozzles 1.

Instead of the sealant pattern as shown in the first to third embodiments, the sealant pattern on the recording-element substrate 2 in the fourth to sixth embodiments may alternatively have four sides with the same shape. Although deformation of the nozzles 1 can be minimized to some extent with this sealant pattern, the former sealant pattern with less sealant volume at the B-side is more effective.

It is to be understood that the invention is similarly applicable to appropriate combinations of the above embodiments.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-169351 filed Jun. 27, 2007, which is hereby incorporated by reference herein in its entirety.

What is claimed is:

1. An inkjet recording head comprising:

a recording-element substrate in which multiple sets of nozzles, energy-generating elements, and supply ports are arranged, the nozzles being configured to discharge ink, the energy-generating elements being configured to generate energy used for discharging the ink, the supply ports being configured to supply the ink to the nozzles; and a sealant disposed around the recording-element substrate, wherein the supply ports include a first supply port disposed proximate to a first edge of the recording-element substrate and a second supply port disposed proximate to a second edge of the recording-element substrate, the second edge being opposite to the first edge as viewed in an arrangement direction in which the multiple sets are arranged, wherein, as viewed in the arrangement direction, a distance between the second edge and the second supply port is shorter than a distance between the first edge and the first supply port, and wherein a volume of the sealant near the second edge is smaller than a volume of the sealant near the first edge.

2. The inkjet recording head according to claim 1, wherein, as viewed in the arrangement direction, a width of a region occupied by the sealant near the first edge is greater than a width of a region occupied by the sealant near the second edge.

3. The inkjet recording head according to claim 2, wherein the width of the region occupied by the sealant near the second edge decreases from an end of the region towards a center thereof as viewed in a direction crosswise to the arrangement direction.

4. The inkjet recording head according to claim 1, wherein a depth of a region occupied by the sealant near the first edge and/or a depth of a region occupied by the sealant near the second edge vary in the arrangement direction.

5. The inkjet recording head according to claim 1, further comprising a plurality of columnar filters disposed adjacent to the supply ports, wherein the number of columnar filters disposed adjacent to the second supply port is greater than the number of columnar filters disposed adjacent to the first supply port.

6. The inkjet recording head according to claim 1, wherein, as viewed in a direction crosswise to the arrangement direction, the nozzles that communicate with the second supply port are arranged at a density that is lower than that of the nozzles that communicate with the first supply port.

7. The inkjet recording head according to claim 1, wherein the second supply port is divided into a plurality of segments.

* * * * *